United States Patent [19]

Agarwal et al.

[11] 3,960,513

[45] June 1, 1976

[54] METHOD FOR REMOVAL OF SULFUR FROM COAL

[75] Inventors: Jagdish Chandra Agarwal, Concord; Richard Andre Giberti, Waltham; Louis John Petrovic, Sudbury, all of Mass.

[73] Assignee: Kennecott Copper Corporation, New York, N.Y.

[22] Filed: Mar. 29, 1974

[21] Appl. No.: 456,047

[52] U.S. Cl. ..... 44/1 R; 423/511; 423/522; 423/558; 201/17

[51] Int. Cl.[2] ..... C10L 9/00; C10B 17/00

[58] Field of Search ..... 201/17; 44/1 R, 1 C; 208/8; 423/511, 522, 558; 75/6

[56] References Cited

UNITED STATES PATENTS

| | | | |
|---|---|---|---|
| 200,663 | 2/1878 | Morey | 44/1 A |
| 618,104 | 1/1899 | Kenevel | 201/17 X |
| 2,338,634 | 1/1944 | Fuchs | 44/1 R X |
| 3,214,346 | 10/1965 | Mason et al. | 201/17 X |
| 3,768,988 | 10/1973 | Meyers | 44/1 R |
| 3,824,084 | 7/1974 | Dillon et al. | 44/1 R |

*Primary Examiner*—Carl F. Dees

[57] ABSTRACT

A process for reducing the amount of free and combined sulfur, such as pyritic, organic or elemental sulfur in coal; removing of these sulfur species may be made in an acid, basic or neutral solutions; at least 50 percent and up to 90 percent of sulfur, by weight, originally present in coal may be removed.

23 Claims, 3 Drawing Figures

COAL
CRUSHER
11
GROUND COAL
$H_2SO_4$
$O_2$
C.S.T.R.
41
COAL
$Fe\,SO_4$
$H_2SO_4$
$H_2O$
$H_2O$
14
$Fe\,SO_4$
$H_2SO_4$
$H_2O$
WASH LIQUOR
22
10
18
WASHING SECTION
20
WASH LIQUOR
21
23
25
24
$H_2O$
LIME
27
28
GYPSUM
IRON HYDROXIDE
WET COAL CONTAINING
ELEMENTAL SULFUR
42
A
43
$H_2O$
COAL SOLVENT CONTAININGS
44
46
FILTER W/WASH
45
47
COAL TO POWER PLANT OR AGGLOMERATOR
SOLVENT
48
SOLVENT/S
49
DISTILLATION
50
51
52
53
FILTER
54
SULFUR

METHOD FOR REMOVAL OF SULFUR FROM COAL

This invention pertains to reduction of the amount of sulfur in coals. More particularly, this invention pertains to removal of pyritic sulfur, elemental sulfur, and organic sulfur from coal containing the same whereby a slurry of coal in various aqueous media is subjected to treatment with oxygen at elevated temperatures and pressures and the solubilized sulfur product is removed from the coal slurry, by various means, as a sulfate ($SO_4$—ion), or as a mixture of elemental sufur and a sulfate, or as a sulfate and an organic fraction.

BACKGROUND OF THE INVENTION

With increasingly stricter air quality standards and with increasingly greater energy demand being experienced and the failure to satisfy this demand with oil, the coal reserves have become more and more attractive as a practically unlimited source of energy. However, many of the coal deposits are found with high sulfur content which has imposed a severe economic penalty on these coal deposits because of air quality requirements and thereby prevented the ready entry into the market of high sulfur content coal. A high sulfur content coal is defined as having greater than 0.5 to 1.0 percent by weight of sulfur in elemental or combined form. Although various methods have been tried for removal of sulfur from various grades of coal, economic considerations have also rendered these methods highly unattractive. Hence, a great endeavor has been made to convert coal directly into a usable fuel which would meet air quality standards. However, the best processes which are known to us remove considerable smaller percentage of sulfur from coal, only about half of that possible according to the present physical processes. Also, not all sulfur species found in coal are removed when practicing some of the prior art processes.

In upgrading coal, it must be remembered that a very high volume industrial commodity is being handled. For this reason, any process which requires upgrading of this material must be economically competitive, a viable alternative to other processes, and a process with little, if any, overall penalty, either associated with disposal problems or air quality problems.

Still further, the process by which coal is upgraded as distinguished for the process by which coal is used must by itself be such that it does not affect air quality standards or affect these to a considerably smaller degree than the overall benefit which is gained.

DETAILED DESCRIPTION OF THE INVENTION

Figure 1:
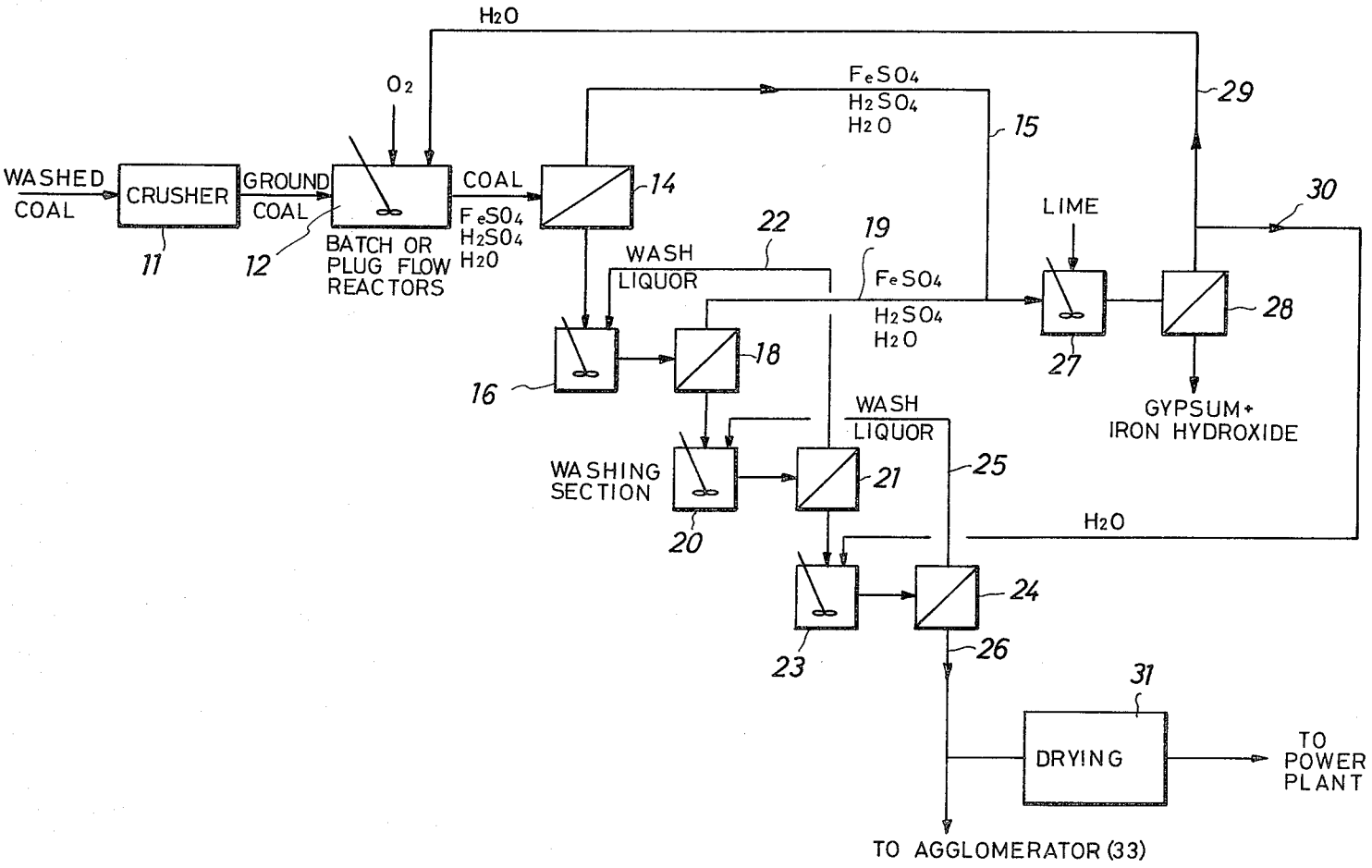

According to the invention, coal is crushed to a size at least minus 2.0 inches (2 × 0 inches conventionally designated in the coal art as consisting of all particles obtained by crushing coal defined as minus 2 inches; consequently minus 2.0 inches includes all particles no matter how small). Generally, particles which are of a size presenting filtration problems should constitute only a small portion e. g. 5 percent. It has thus been found that if the crushed coal is introduced into a reactor in an aqueous medium as a slurry, oxygen is introduced in the reactor under pressure such as about 300 psig, coal is maintained under an elevated temperature in intimate contact with oxygen and, if necessary, stirred, the pyritic sulfur in coal is converted to a soluble species such as ferrous sulfate, ferric sulfate, and sulphuric acid. In addition, from about 0–50 percent, generally from 0–20 percent of the organic sulfur present in the coal may be removed when coal is treated according to an embodiment outlined herein. A solid-liquid separation of the thus generated or freed species, in the aqueous medium, is then practiced. The removed soluble sulfates and sulfuric acid are thereafter neutralized such as with lime, and the coal as a solid is appropriately worked up thereafter to process it for use. Elemental sulfur is removed by an appropriate solvent and/or elutriant, e. g., kerosene or other means; organic sulfur is removed by an appropriate elutriant and/or solvent, e.g., ammonium solution.

Thus, a coal-oxygen reaction may be carried out in an aqueous medium in a continuously stirred reactor in the presence of acid which facilitates the formation of free or elemental sulfur in addition to iron sulfate and the sulfuric acid as well as provides for organic sulfur removal. As before, the reaction product is subjected to a solid-liquid separation stage, the reaction liquid neutralized and the solid processed, such as by washing. Thereafter the additionally formed elemental sulfur is removed by a solvent for elemental sulfur, or by vacuum or hot water treatment, such as by heating and vaporizing or heating and driving off sulfur in the presence of hot water.

In another aspect of the invention, sulfur removal is effected by leaching a crushed coal slurry with oxygen in an aqueous medium whereby the slurry is maintained under pressure in a continuously stirred reactor but, in addition, ammonium hydroxide is introduced in said reaction (e.g., up to 3.0 molar ammonium hydroxide, as an illustration, 0.1 molar ammonium hydroxide solution is still suitable). By this process ammonium sulfate is formed in addition to iron sulfate. This variation also removes up to about 50 percent of the organic sulfur in coal.

Again, a coal slurry treated in this manner is subjected to a solid-liquid separation, a stagewise recovery of ammonium sulfate for countercurrent washing (applicable to all three aspects of this invention discussed herein) and the recovery of ammonium sulfate for recycling to the reactor. Still further, liquid from each stagewise washing is combined with the reaction liquid, neutralized and ammonium hydroxide regenerated. No elemental sulfur extraction step is required, although it may be practiced as a combination option when sulfur-laden coal is first treated such as in a reactor in the presence of acid and the material is thereafter worked up by a separate sequence with ammonia to remove organic sulfur, i.e., up to 50 percent of organic sulfur may be removed; at least 10 percent of organic sulfur removal is very practical. Organic sulfur is generally removed with leach and wash water and may be precipitated with lime.

Figure 2:
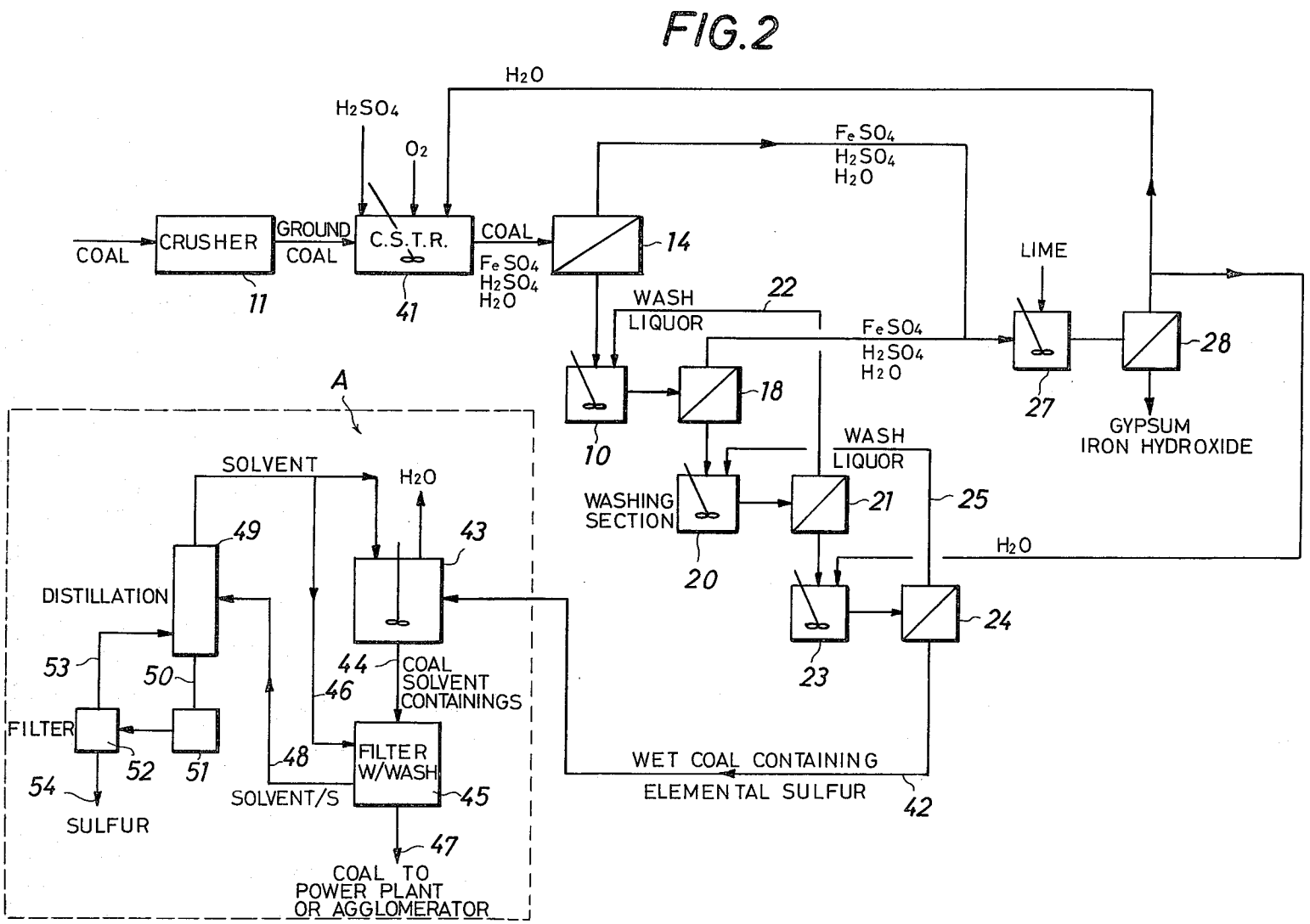
Figure 3:
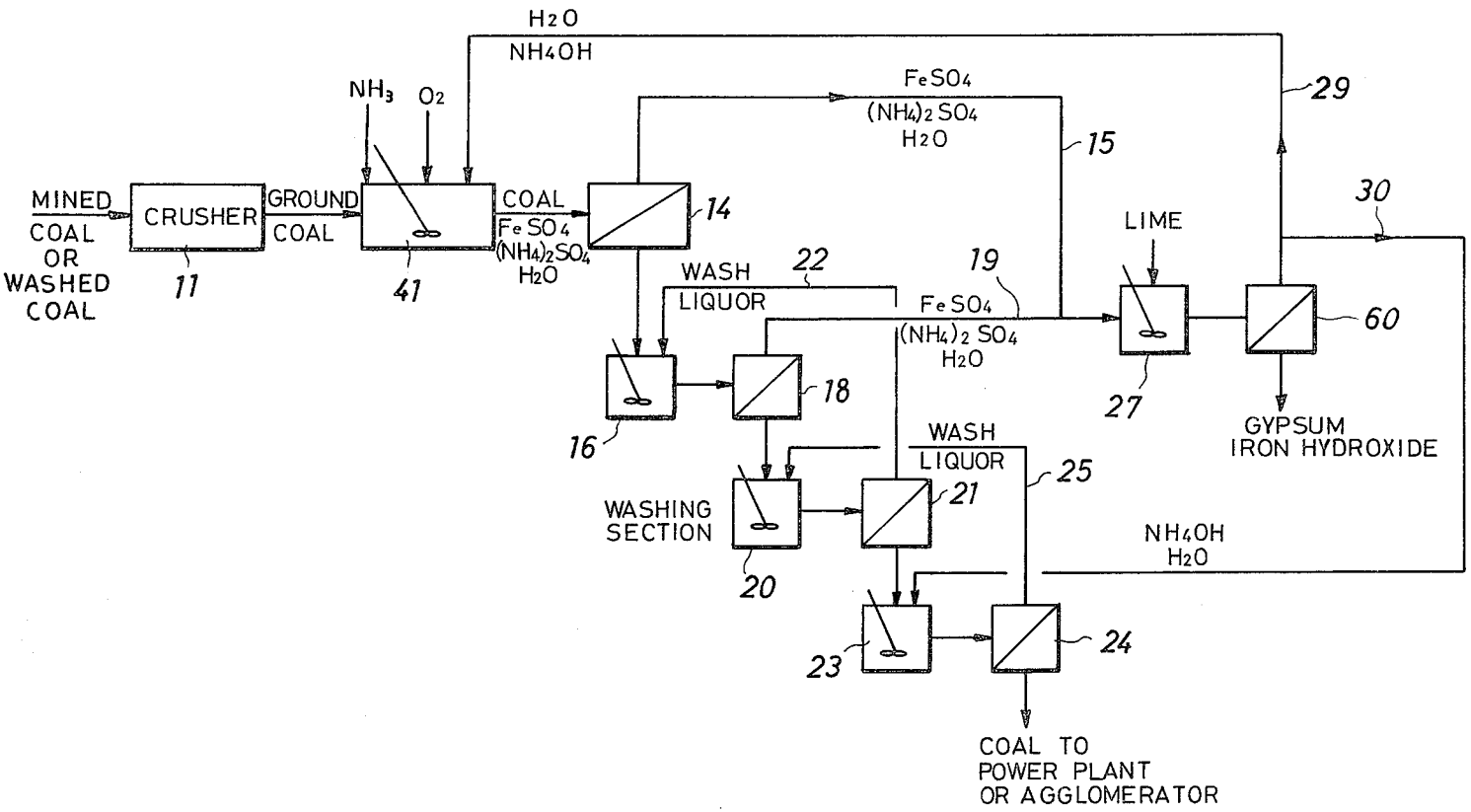

In accordance with the invention and without limiting the scope thereof, it is illustrated in the following drawings wherein:

FIG. 1 illustrates pressure oxygen leaching of pyritic sulfur containing coal in a neutral starting solution; the process in the drawing is illustrated as coupled to an agglomerator or an existing power plant showing the various stages for effective removal of the impurities;

FIG. 2 is another illustration of an embodiment herein showing pressure oxygen leaching of pyritic sulfur containing coal in an acidic solution whereby coal is subjected to the additional solvent extraction processing for removal of elemental sulfur; the part of Figure indicated by dashed lines and Item A illustrates the aspect of the invention pertaining to the additional elemental sulfur extraction step;

FIG. 3 illustrates another aspect of the present invention whereby pressure oxygen leaching of coal is effected in a basic solution such as with the formation of ammonium or sodium sulfate, the removal of the sulfate, and regeneration such as of ammonium hydroxide for recycle use in the process.

With reference to the above-identified Figures, and specifically FIG. 1 illustrating the first embodiment, a coal as mined and/or from a mine washed and designated as Illinois No. 6 is introduced into a crusher 11 wherein it is crushed to at least minus 2.0 inches.

A crusher, such as available from Penn Crusher Co., is conveniently used for this purpose. Thereafter, the crushed coal is introduced into a batch or plug flow reactor 12 which may be provided with a stirrer or some other means for agitation such as fluidization by recirculating reaction liquid or oxygen, or oxygen-laden gas, e.g., air. Coal introduced in the reactor has the following sulfur assay.

| | Weight Percent Sulfur as: | | | |
|---|---|---|---|---|
| | $^{--}SO_4$ | Pyrite | Organic | Total |
| Ohio No. 6 | 0.17 | 2.10 | 0.78 | 3.05 |

Other illustrative types of coal which can be upgraded are listed below.

| | Weight Percent Sulfur as: | | | |
|---|---|---|---|---|
| | $^{--}SO_4$ | Pyrite | Organic | Total |
| Illinois No. 6 | 0.19 | 1.82 | 2.16 | 4.17 |
| Indiana No. 6 | 0.23 | 2.76 | 1.07 | 4.05 |
| Kentucky No. 9 | 0.16 | 2.65 | 1.12 | 3.93 |

Generally, all types of coal containing sulfur may be subjected to the process, e.g., Western Coals, Mid-west High Sulfur Coals, etc.

Generally, oxygen is used for reacting with sulfur in the coal. Instead of oxygen, oxygen-enriched air may also be used with oxygen enrichment being in a weight range from 0 to 100 percent a range from 80 to 100 percent is preferred. In order to prevent the combustion of coal, it is being reacted with oxygen in aqueous phase and generally in a ratio of coal to aqueous phase of 1 to 60 percent by weight—preferably from 10 to 25 percent. The pressures in the reactor employed are from 0 to 1000 psig—preferably from 30 psig to 350 psig. Although air can be used, power requirements may be excessive to pump air. The reactor generally is filled with the constituent parts in the following proportions:

| Constituent Ratios, by weight | From | To |
|---|---|---|
| Coal | 1 | 1 |
| $O_2$ | 0.085 | 0.18 |
| $H_2O$ | 99 | 0.667 |

From the above, the slurry density is evident.

Heating coils may be provided in the reactor so that the reaction may be carried out at a temperature 50°F to 450°F-preferably from 120°F to 300°F. Although the reaction of oxygen with sulfur produces a certain amount of heat, it still may be necessary to augment or remove heat and for that purpose the heating coils are used or introduced, e.g., by heat exchange between slurry, before and after reactors (not shown in drawings).

After the coal has reacted for a period from about 15 minutes to 24 hours (preferably from 1 to 4 hours), the liquid reaction phase rich in ferrous, ferric sulfate, and sulfuric acid is introduced in a liquid-solid separation device 14, such as a thickener or rotary filter, wherefrom the liquid laden with iron sulfate, sulfuric acid, and water is removed. The solid material, that is coal, is introduced into a means for washing the same such as mixer-settlers 16 in FIG. 1. After washing, the coal is then introduced in a solid liquid separation stage labeled 18 in FIG. 1, and separated, such as in device 14, from wash liquor. The wash liquor contains lesser amounts of iron sulfate and sulfuric acid. Generally, per ton of coal produced from 1000–10,000 gallons of wash water is used. The constitution of liquid in the flow stream designated as 15 in FIG. 1 is as follows:

0.003–0.75 Molar $FeSO_4$
0.003–0.75 Molar $Fe_2(SO_4)_3$
0.003–0.75 Molar $H_2SO_4$ The constitution of liquor in the flow stream 19 shown in FIG. 1 is as follows:

0.0015–0.06 Molar $FeSO_4$
0.0015–0.06 Molar $Fe_2(SO_4)_3$
0.0015–0.06 Molar $H_2SO_4$ The coal from the separation means, such as 18, is then introduced into another washing device 20 or it may be introduced directly into a power plant if no additional washing is required. If further washing is needed, then coal is subjected again to washing in a countercurrent fashion, sent to a separation stage 21 wherefrom the wash liquor from that stage is introduced in washing section 16 via line 22. Again, coal from the separation stage 21 may be introduced into an additional washing section 23, washed such as for a period of 5 to 30 minutes which is of about the same duration as in the washing device 16 and 20. From the final separation stage 24, coal is ready for discharge or suitably prepared for burning in a power plant (such as by drying in a dryer 31 or by centrifuging). The wash liquor from the separation stage 24 via line 25 is introduced into wash section 20; and thus, there is very little carryover liquor which is being discharged with coal. Generally, the moisture content of the coal discharged via line 26 from separation device 24 is about 10 to 30 percent.

It is noted that the wash liquor from stage 24, when introduced into washing section 20, is in a countercurrent fashion again introduced into initial wash section 16, from which, via separator 18 and line 19, iron sulfate and sulfuric acid enriched wash liquor is introduced into a neutralization vessel 27. Generally, iron sulfate and sulfuric acid enriched wash liquor is combined with the liquid reaction medium (via line 15 from reactor 12) and the combined stream is introduced into a neutralization vessel 27. As a practical matter, lime is used to neutralize the liquor. Any neutralization agent that will precipitate sulfate and/or remove sulfur may be used. Examples are $Ca(OH)_2$, $CaCO_3$, $Ba(OH)_2$, $Sr(OH)_2$, $Na(OH)$, $NH_3$, etc. A residence time of the iron sulfate and sulfuric acid containing liquor is generally from 10 to 60 minutes in the neutralization stage. Negligible amounts of iron are carried over line 29 back into the reactor. After neutralization, gypsum and iron hydroxide are separated from the neutralized water which is then recirculated back into the reactor as reaction medium and the cycle is initiated anew.

Further drying of the coal may be indicated, and dryer 31 may remove the moisture to within the conventionally acceptable limits. If shipping of coal is necessary or some other use requires agglomeration, a suitable process may be employed such as briquetting, etc. The agglomeration is carried out in a conventional manner in an agglomerator 33, such as by adding a binder and compacting the coal particulates.

In a separation stage 28, which is generally a filter, such as a rotary drum filter, gypsum and iron hydroxide which has precipitated are substantially completely removed. Per ton of coal about 30 to 70 lbs. of iron as iron hydroxide and 200 to 450 lbs. of gypsum are formed. These can be suitably employed for a purpose such as providing a solid fill.

The sulfur assay of coal suitable for power plant is generally 0.6 No. sulfur per million B.T.U.

Turning now to FIG. 2, the pressure oxygen leaching of coal such as Illinois No. 6 of a particle size less than 2 inches is carried out in an acidic solution whereby the acid is introduced into the reactor. Generally, the acid is 0.075 molar sulfuric acid; but it can be in a range up to 1.0 molar sulfuric acid. Lower amounts of acid may be used such as 0.001 molar and lower, but then the process is more nearly like the process as illustrated in FIG. 1. Hence, the process depicted in FIG. 2 may be operated with an acid concentration of 0.001 molar and up. Other acids suitable for the purpose are $HNO_3$, $H_3PO_4$, and acetic acid. Coal thus treated is then worked up the same as in FIG. 1, and the respective items in FIG. 2 have been identified with the same reference numerals as these perform the same functions in essentially the same manner.

However, item 41 designates a continuously stirred tank reactor capable of being operated under pressure from 0 to 1000 psig. The section identified in FIG. 2 by the dashed lines and Item A depicts the removal of elemental sulfur coming from separator stage 24 via line 42.

The coal has the following assay in percent by weight as introduced into reactor 43:

Weight Percent Sulfur as:

| $^{--}SO_4$ | Pyrite | Organic | S° | Total |
|---|---|---|---|---|
| 0.08 | 0.10 | 0.71 | 0.20 | 1.09 |

An elemental sulfur solvent which may be conveniently used is kerosene or toluene as a preferred solvent. Other solvents which may be used are: acetone, carbon disulfate, benzene, aniline, carbon tetrachloride, hexane, xylene, p-dichlorobenzene, coal tar oil, cycohexane, heptane, sodium sulfide, aqueous solutions of $NH_3$, NaOH, $Mg(OH)_2$, $Ca(OH)_2$, $Ba(OH)_2$, acetic acid or mixtures of same. The solvent is (or mixtures of solvents are) introduced into the solvent extraction vessel 43; and when removed from the same via line 44, it has the following amount of sulfur present: 0.1–12.0 gS/100 g solvent.

The solvent, together with coal, is introduced into the filter-wash vessel 45, e.g., rotary vacuum filter and is further treated with solvent introduced in the filter/-wash vessel via line 46. Coal which is then suitable for agglomerating or drying for use in a power plant or agglomerator 33 (as shown in FIG. 1) is removed from the filter/wash vessel by line 47 and has the following assay:

Weight percent sulfur as:

| $^{--}SO_4$ | Pyrite | Organic | S° | Total |
|---|---|---|---|---|
| 0.08 | 0.10 | 0.71 | 0 | 0.89 |

The solvent from this stage is introduced into the evaporation stage via line 48 in an evaporator operated at 83.5°C for toluene or other temperatures associated with the boiling point of the solvent used.

The bottoms of the evaporator constitute substantially sulfur in the form of S° (elemental sulfur) which is introduced via line 50 into a separation stage 51 from which sulfur is separated by means of a filter 52. The filter is conveniently in the form such as a rotary vacuum filter.

The solvent, which is removed from filter 52, is introduced via line 53 into evaporator 49. Sulfur is removed via line 54 from filter at a rate of about 4 to 10 lbs. per ton of treated coal. In accordance with the reaction process illustrated in FIG. 2, coal may be treated in the same scheme as in FIG. 1; or it may be treated in the presence of an acid for another cycle, and thus it may necessitate the addition of the section depicted in the flow sheet by item A and previously described.

With reference to FIG. 3, it follows the same scheme as illustrated in FIG. 1 except that the vessel 28 in FIGS. 1 and 2 is replaced by vessels, such as 60, illustrated in FIG. 3, which is suitable for handling ammonium hydroxide introduced in the reactor 41 as a reactant such as of a molar composition with a range up to 3.0. The reaction of coal with oxygen is in basic medium; when the amount of ammonium hydroxide is low, e.g., 0.01, the process is still operative, but it is then nearly that shown in FIG. 1. Hence, a lower range for ammonium hydroxide may be 0.05 molar.

In the following examples, the various embodiments illustrated in FIGS. 1, 2 and 3 are set forth indicating the recovery and the yields thereof. The embodiments are furnished as an illustration of the invention and not for the purpose to limit the scope thereof.

EXAMPLE 1

With reference to FIG. 1, coal which is introduced into the ball mill 11, is ground to −100 mesh size and fed into the reactor 12 by adding recycled water thereto such that the reaction medium has 4.3 percent by weight coal slurry. Under a reaction pressure of 300 psig oxygen, the liquid medium is held at 130°C. for 6.5 hr. (residence time); sulfur from pyritic sources is then substantially completely converted to a soluble sulfate species such as a ferrous sulfate, ferric sulfate and sulfuric acid.

A solid liquid separation as illustrated in FIG. 1 is then carried out in a sequence as indicated in describing FIG. 1.

In accordance with the procedure as outlined before and as shown in FIG. 1, Illinois No. 6 coal containing 1.53 percent by weight pyritic sulfur was converted to a coal containing less than 0.03 percent by weight pyritic sulfur with no change in the sulfate sulfur in the material balance and approximately 10 percent decrease in the amount of organic sulfur being present in the coal.

The BTU/lb. of this coal is about 9,500 to 12,000 (moisture free basis) (BTU = British thermal units).

EXAMPLE 2

In accordance with the invention as illustrated in FIG. 2, coal of the same composition as shown in Example 1 was introduced into the vessel 41 shown in FIG. 2. Oxygen under pressure of 60 psig was introduced in the vessel and the coal slurry maintained at 100°C. for 6.5 hours. The slurry is 2.15 percent by weight coal to liquid; the liquid is 0.075 molar sulfuric acid. In accordance with this process, elemental sulfur forms in addition to the iron sulfate and sulfuric acid. The product slurry undergoes a solid-liquid separation as illustrated in FIG. 1. In addition, the sulfur removal step is carried out by washing the coal with kerosene to remove sulfur. An Illinois No. 6 coal containing 2.62 percent by weight pyritic sulfur has been converted to a coal containing 0.09 percent by weight pyritic sulfur with approximately 9 percent of the pyritic sulfur being converted to elemental sulfur. The elemental sulfur is determined and expressed as based on the amount of sulfur removed such as from line 54 as based on the assay of coal introduced via line 42 in the solvent extraction stage 43.

EXAMPLE 3

With reference to FIG. 3, which follows the procedure described in Example 1 except that in the reaction vessel 41 the introduced liquid is 0.1 molar ammonium hydroxide, the sulfur products formed in the reaction are ammonium sulfate in addition to iron sulfate.

Again, the product slurry undergoes a solid-liquid separation, the same as illustrated in previous Examples 1 and 2. However, the neutralization step in conjunction with the precipitation of gypsum and iron hydroxide also regenerates the ammonium hydroxide solution for use in the reactor 41. Therefore, no sulfur extraction step is required. In accordance with the above procedure, an Illinois No. 6 coal of the same mesh size as in Examples 1 and 2 containing 1.36 percent by weight pyritic sulfur was converted to a coal containing 0.07 percent by weight pyritic sulfur with an 80 percent decrease in sulfate sulfur and a 30 percent decrease in organic sulfur. Up to 50% of organic sulfur may be removed when practicing the process illustrated herein. Coal from this stage then can be subjected again to a reaction sequence such as in FIGS. 1 and 2.

As illustrated above, a process is described by which sulfur can be readily removed from coal such as when leaching pyritic sulfur, removing elemental sulfur and/or removing organic sulfur. It is now possible to produce coal for use in power plants of outstanding combustion characteristics whereby it may be burned and still meet the air quality standards imposed in various localities because at least 50 percent and up to 90 percent by weight of sulfur in coal may now be removed.

As is evident from the above, coal may be subjected to a combination of steps depending on the manner in which the coal assays; and it may be subjected to one or more of the processes illustrated above, in one or more stages. In the event high elemental sulfur coals are encountered, these can be readily treated by the process illustrated in Example 2 as shown in FIG. 2 and thus coal of high quality may be obtained.

Consequently, in accordance with the process herein, such as when practicing the process with a neutral starting solution (FIG. 1), elemental sulfur is not formed as such, organic sulfur is capable of being extracted, and pyritic sulfur is removed as a sulfate ion. In accordance with the process in FIG. 2, oxygen leaching of coal in an acidic solution will allow the removal of sulfate ions and elemental sulfur formed from pyrites. No organic sulfur is extracted in the form of organic sulfur but it may be converted to removable species. With respect to the process disclosed in FIG. 3, pyritic origin sulfur is removed as sulfate ions; and organic origin sulfur is capable of being removed as soluble sulfur compound by a solvent for same such as ammonium solution or aqueous solutions of sodium hydroxide, magnesium hydroxide, calcium hydroxide, barium hydroxide, etc.

As only the final amount of sulfur of the pyritic elemental, or organic type is analyzed, the exact knowledge of the conversion, solubilizing or reaction of each of the species during the process is unnecessary because removal of the sulfur is sought to be maximized. Hence, if needed, any combination of the three distinct embodiments may be used depending on the source of coal, its original sulfur composition, and the end result dictated by the user of coal or air quality standards. It is, however, possible to maximize sulfur removal by employing the three embodiments with respect to the pyritic, organic, or elemental sulfur composition in coal as these species are removed in accordance with the three embodiments.

Organic sulfur is defined as sulfur bound by carbon to sulfur valances and are in coal formed in the form such as mercaptans, sulfides, disulfides, thiophenes, etc. Elemental sulfur is defined as found in coal or formed by reaction with oxygen in an acidic medium along with sulfate.

What is claimed is:

1. A process for reducing the amount of free and combined sulfur in coal and removing of same from coal comprising the steps of:

introducing a crushed coal into a reaction zone in an aqueous medium in the presence of oxygen whereby the ratio of coal to oxygen to water based on weight percent is from 1.0:0.085:99 to 1.0:0.18:0.667;

reacting oxygen with said sulfur in said coal for a period sufficient to convert said sulfur in said coal to a soluble species thereof, or elemental sulfur;

separating said liquid reaction medium from said coal;

working up said coal whereby sulfur of elemental, pyritic or organic origin is removed;

neutralizing said reaction medium with a neutralizing liquor whereby iron and a sulfate is precipitated from the neutralized, liquid reaction medium;

and reintroducing a portion of said neutralizing liquor into the reaction zone.

2. The process of claim 1 wherein at least about 50 percent of said sulfur in said coal is converted to an iron sulfate, sulfuric acid or elemental sulfur.

3. The process according to claim 2 wherein a portion of the neutralized liquid reaction medium is countercurrently used for working up said coal and then combined with the liquid reaction medium for neutralization.

4. The process according to claim 2 and wherein the neutralized reaction medium consists of from about 1.5 to 95.2% of the liquid reaction medium for coal, after reaction of the coal and is combined with dilute wash liquor countercurrently removed from the working up of coal.

5. The process according to claim 1 wherein lime is used as a neutralizing agent.

6. A process for reducing of sulfur in coal such as pyritic sulfur, whereby coal of a lower sulfur content, expressed on basis of elemental sulfur in the same is obtained, the steps comprising:

introducing a crushed coal as a water slurry in a reaction zone in the presence of oxygen and an acid whereby oxygen is at a pressure from 0 to 1000 psig;

maintaining said coal in said reactor for a period sufficient to solubilize for removal said sulfur present in said coal;

removing said coal and said reaction medium from said reaction zone;

separating said reaction medium and coal from each other;

countercurrently washing coal with a wash liquor;

combining said wash liquor with said reaction liquor;

neutralizing said combined wash and reaction liquor;

separating precipitated sulfates and iron from said combined wash and reaction liquor;

introducing said washed coal into a solvent extraction zone;

washing said coal with a solvent for removing elemental sulfur;

separating said coal from said solvent;

distilling said solvent and removing sulfur therefrom;

and reintroducing said solvent in said coal and solvents separation zone.

7. The process of claim 5 wherein at least about 50% and up to 90% of said sulfur in said coal is removed.

8. The process according to claim 6 wherein the liquid introduced into the reaction zone is a liquid having a sulfuric acid of a molar content up to 1.0, based on the reaction liquid in said reaction zone.

9. The process according to claim 6 wherein lime is used for neutralizing the combined wash liquor and reaction liquor.

10. The process according to claim 6 wherein coal is introduced in said solvent extraction zone;

water expelled by introduction of solvent; and coal and solvent stirred in a vessel until elemental sulfur is extracted from said coal.

11. The process according to claim 6, wherein a solvent containing sulfur is introduced into a filtration zone, washed with additional solvent, and coal is separated from said solvent.

12. The process according to claim 9 and wherein the solvent rich in sulfur is introduced into a distillation zone, sulfur is removed as bottoms and filtered to remove residual traces of solvent and the sulfur free solvent introduced into a solvent extraction stage.

13. In a process for removing pyritic sulfur from coal whereby the amount of sulfur is lowered and said coal upgraded, the steps comprising:

introducing a crushed coal into a reactor zone as a slurry of 1–60 parts of coal to 40–99 parts of water, said water being enriched with up to 3.0 molar ammonium hydroxide;

introducing oxygen in said reaction zone at a pressure from 0 to 1000 psig;

maintaining said pressure in said reaction zone for a period of 15 minutes to 24 hours;

maintaining the reaction zone within said period at a temperature from 50° to 450°F;

discharging said coal and a reaction liquor rich in iron sulfate and ammonium sulfate;

separating said coal and said reaction liquor from each other;

washing said coal countercurrently with a wash liquor containing ammonium hydroxide thereby lowering the amount of organic sulfur in said wash;

combining said countercurrently used liquor from the last stage of countercurrent washing with said reaction liquor;

neutralizing said combined reaction liquor and wash liquor;

separating said neutralized sulfates and iron hydroxides and regenerating as a neutralized liquor an aqueous medium for reaction stage comprising water and ammonium hydroxide wherein said aqueous medium is of up to 3.0 molar ammonium hydroxide;

introducing said ammonium hydroxide into said reaction stage;

and recovering from the last countercurrent wash stage coal with reduced sulfur content.

14. The process according to claim 11 wherein at least 3 wash stages are employed for obtaining a wash liquor rich in iron sulfate and ammonium sulfate.

15. The process according to claim 11 wherein lime is used for neutralizing the combined wash liquor and reaction liquor and gypsum and iron hydroxide is separated from said neutralized liquor and said neutralized liquor reintroduced in said reaction zone as aqueous ammonium hydroxide.

16. A process for reducing the amount of sulfur present in coal, including pyritic sulfur, organic sulfur and sulfate sulfur comprising the steps of:

introducing crushed coal into a reaction zone as a slurry of 1–60 parts of coal to 40–99 parts of water, the water in the reaction zone containing up to 3.0 molar ammonium hydroxide;

introducing an oxygen containing gas into said reaction zone at a pressure from 0 to 1000 psig;

maintaining said pressure in said reaction zone for a period of 15 minutes to 24 hours;

maintaining the reaction zone within said period at a temperature from 50° to 450°F;

discharging said coal and a reaction liquor rich in iron sulfate and ammonium sulfate;

separating said coal and said reaction liquor from each other; and washing said separated coal with a wash liquor including wash liquor containing ammonium hydroxide.

17. The process of claim 16 wherein the aqueous slurry in the reaction zone contains 0.1 to 3.0 molar ammonium hydroxide.

18. The process of claim 16 comprising the steps of combining the wash liquor containing soluble organic sulfur and sulfate with the reaction liquor;

neutralizing the combined liquor and wash liquor to precipitate sulfates and iron hydroxides;

separating the neutralized sulfates and iron hydroxides and regenerating as a neutralizd liquor an aqueous medium for the reaction stage comprising water and ammonium hydroxide wherein said aqueous medium is of up to 3.0 molar ammonium hydroxide;

introducing said aqueous medium and said ammonium hydroxide into said reaction stage;

and recovering from the wash stage coal with reduced sulfur content.

19. A process for reducing the amount of sulfur present in coal, including pyritic sulfur, organic sulfur and sulfate sulfur comprising the steps of:

introducing a crushed coal into a reaction zone as a slurry of 1–60 parts of coal to 40–99 parts of water, adding to said aqueous slurry sufficient acid to maintain an acid concentration of from .001 to 1.0 molar acid;

introducing an oxygen containing gas into said reaction zone at a pressure from 0 to 1000 psig;

maintaining said pressure in said reaction zone for a period of 15 minutes to 24 hours;

maintaining the reaction zone within said period at a temperature from 50° to 450°F;

discharging said coal and elemental sulfur and a reaction liquor rich in iron sulfate and said acid;

separating said coal and said reaction liquor from each other; and washing said coal with a wash liquor.

20. The process of claim 19 wherein the acid is selected from the group consisting of $H_2SO_4$, $HNO_3$, $H_3PO_4$ and $CH_3COOH$.

21. The process of claim 19 wherein the acid concentration is 0.075 to 1.0 molar $H_2SO_4$.

22. The process of claim 19 wherein the washed coal is introduced into a solvent extraction zone;

the coal is contacted in said zone with an organic solvent selective for removing elemental sulfur; and separating said washed coal from said solvent containing the elemental sulfur.

23. The process of claim 19 wherein the wash liquor from the coal washing step is combined with the reaction liquor;

the combined wash and reaction liquor are neutralized to precipitate sulfates and iron; and the precipitated sulfates and iron are separated from said liquor.

* * * * *